US006265009B1

(12) United States Patent
Kjelgaard et al.

(10) Patent No.: US 6,265,009 B1
(45) Date of Patent: Jul. 24, 2001

(54) PROTECTED CONTAINER

(75) Inventors: Tom Kjelgaard; Ulf Lindsjo, both of Lund; Birger Nilsson, Malmo, all of (SE)

(73) Assignee: Tetra Laval Holdings & Finance SA, Pully (CH)

( * ) Notice: Subject to any disclaimer, the term of this patent is extended or adjusted under 35 U.S.C. 154(b) by 0 days.

(21) Appl. No.: 09/284,518

(22) PCT Filed: Oct. 29, 1996

(86) PCT No.: PCT/SE96/01387

§ 371 Date: Jul. 19, 1999

§ 102(e) Date: Jul. 19, 1999

(87) PCT Pub. No.: WO98/18680

PCT Pub. Date: May 7, 1998

(51) Int. Cl.[7] ..... A23L 3/00

(52) U.S. Cl. ..... 426/407; 426/398; 426/412; 229/5.81

(58) Field of Search ..... 426/126, 127, 426/124, 113, 412, 398, 407; 229/5.81, 5.84, 198.2

(56) References Cited

U.S. PATENT DOCUMENTS

| | | | | |
|---|---|---|---|---|
| 3,093,287 | | 6/1963 | Stark | 229/122.32 |
| 3,107,586 | * | 10/1963 | Ragan | 493/276 |
| 3,341,349 | * | 9/1967 | Feeney et al. | 229/100 |
| 3,495,507 | | 2/1970 | Haas et al. | 493/287 |
| 3,498,527 | * | 3/1970 | Moors et al. | 229/190 |
| 3,595,465 | * | 7/1971 | Vaillancourt | 206/439 |
| 3,687,351 | * | 8/1972 | Kaercher et al. | 229/5.82 |
| 3,923,238 | | 12/1975 | Thomas | 229/198.2 |
| 3,942,708 | * | 3/1976 | Christensson | 229/5.82 |
| 4,224,367 | | 9/1980 | Scholle | 428/76 |
| 4,239,150 | | 12/1980 | Schadowski et al. | 229/198.2 |
| 4,572,426 | * | 2/1986 | Lisiecki | 229/190 |
| 6,110,548 | * | 8/2000 | Kinsey | 428/34.2 |
| 6,153,241 | * | 11/2000 | Beckeman | 426/412 |

FOREIGN PATENT DOCUMENTS

| | | |
|---|---|---|
| 4218393 | 12/1990 | (DE) . |
| 379308 | 10/1975 | (SE) . |

* cited by examiner

*Primary Examiner*—Milton Cano
*Assistant Examiner*—Robert Madsen
(74) *Attorney, Agent, or Firm*—James Ray & Associates

(57) ABSTRACT

A container is manufactured by means of folding and sealing, and is intended to be used in extremely humid conditions, such as in an autoclave or in a cooling tunnel. The container has at least one liquid absorbing layer and all the cut edges of the container are protected.

8 Claims, 1 Drawing Sheet

PROTECTED CONTAINER

Figure 1:
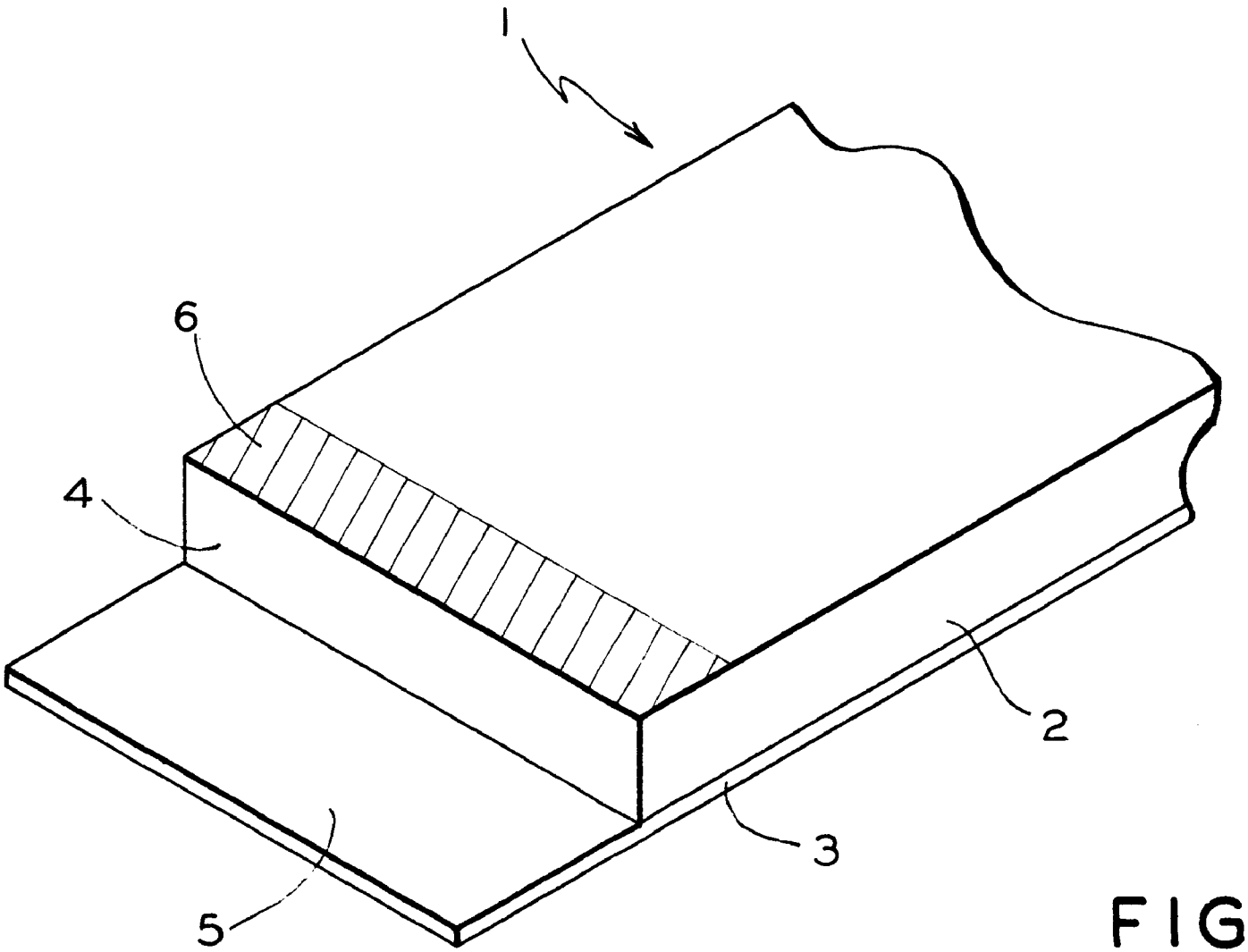

This application is a 371 of PCT/SE96/01387 filed Oct. 29, 1996.

The present invention refers to a container which is manufactured by means of folding and sealing, and which is intended to be used in extremely humid conditions, such as in an autoclave or in a cooling tunnel, the container having at least one liquid absorbing layer. More specifically, the invention relates to a container, in which all the cut edges are protected.

Paper and board are cheap package materials. However, they also have drawbacks in rapidly loosing their mechanical strength properties when exposed to liquid or moisture, which results in that a container which comprises these materials becomes flabby and cumbersome. It has thus been necessary to improve the properties of these materials, either by coating or lamination.

A large group of known containers is thus manufactured from a laminated material comprising a strengthening base layer of a liquid absorbing material as well as a barrier layer of for example aluminium (Al-foil) which is applied against one side of the base layer and which gives the container the desired sealing properties. Furthermore, such a laminated material comprises an outer coating of plastic (usually polyethylene) so that the container easily can be sealed by means of what is called heat sealing.

A dimensional stable liquid impermeable packaging container is for example manufactured from a material web by the web being formed to a tube in such a way that the two longitudinal edges of the web are permanently joined in a longitudinal overlap seam by means of said heat sealing. The tube is filled with the desired filling material and is divided into closed containers by repeated heat sealings of the tube transverse the longitudinal direction of the tube beneath the level of the filling material in the same. The containers are then separated from each other by cuts in the transvers sealings, and the desired geometrical—usually parallelepipedic—configuration is provided by means of an additional forming and heat sealing operation in order to produce the completed packaging containers.

It is important that films of the above-mentioned material, which are to be made weldable, can be brought to fit tightly so that leaking containers with for example milk are avoided. Known package materials with good dimensional rigidity and other necessary mechanical properties for the manufacturing of dimensional stable containers have in practice proved to be difficult to seal by means of heat sealing. The sealing joints have often mechanically been too weak to withstand the outer loads of normal handling of the containers during transport etc., and they have been impaired with local perviousnesses.

One large problem with containers manufactured from a paper or board laminate has always been that they exhibit laminate cut edges exposed to the inside of the container, which contact and easily absorb the liquid content of the container, the desired mechanical rigidity of the laminate and thus the dimensional stability of the container thereby at least locally being impaired or totally lost. The problem has partly been solved by the application of a bridging plastic strip on the above-mentioned overlap seam in the material web formed as a tube during the manufacturing of the laminate to a container. However, in this connection only a protection of the cut edge existing inside a container is obtained.

However, it is likewise important that the remaining cut edges of a container also are protected. The container is often influenced by moisture in the form of water as a liquid or steam, which can be absorbed by the cut edges present on the outside of a finished container. This can for example take place when a cooled container is subjected to the surrounding atmospheric humidity during transport or storage, which humidity is condensed on the container. Also more extreme conditions, such as hot filling as well as preservation by refrigeration and preservation by heat, for example autoclaving, require well protected cut edges on a container.

The purpose of the invention is to provide a container of the kind mentioned by way of introduction, which allows for the elimination of the above-mentioned draw-backs.

The invention will now be explained more in detail with reference to the accompanying drawing, in which FIG. 1 is a cross section through a packaging laminate.

The packaging laminate partly shown in FIG. 1, preferably in the form of a material web, has at least one liquid absorbing layer which usually is a base layer of board but which also can be a barrier layer. A polymeric film 3 is applied on the packaging laminate 1 in the form of a web or a sheet. At the cut edge 4 to be protected a portion 5 of the film protrudes from a sheet 2 parallel to the transport direction of the web, the film advantageously being 2 to 5 mm broader than the thickness of the sheet. The polymeric film 3 applied on the sheet 2 should be of a material having a good vapour barrier in order to protect not only the packaging laminate but also the cut edges from moisture and liquid. Furthermore, the film should be of a material which in other respects has good resistance against chemicals. Examples of such a material are polypropylene, oriented polypropylene, metalized (usually with aluminium) oriented polypropylene, high density polyethylene, linear low density polyethylene, and metalized (usually with aluminium) high density polyethylene. An environmentally safe material can also be used, such as polyester, oriented polyester, metalized (usually with aluminium) oriented polyester, or amorphous polyester, the polyester for example being polyethylene terephtalate.

The polymeric film 3 shall not only confer to the cut edges the required impermeability properties against liquid but also be able to attach to the other side of the packaging laminate. Thus, the portion 5 protruding from the sheet 2 is folded down close to the cut edge 4 and permanently sealed to the cut edge as well as a zone 6 on the opposite side of the sheet 5.

The sealing is preferably accomplished by means of heat sealing so that the protruding portion 5 permanently can be attached to the sheet 2. The heat sealing is accomplished by the zone 6, and thus the cut edge 4, being heated, and the protruding portion is folded over the cut edge and pressed against the zone, the melting of the now heated portion 5 resulting in the formation of a permanently bonded mechanically strong and liquid impervious sealing when the zone 6 is subsequently cooled.

An effective heat sealing is achieved by means of induction heating, blowing with hot air, or irradiation with infrared light of the zone 6.

The protected cut edges can then be joined by means of a known technique, opposed plastic layers being sealed to each other by means of surface fusion in order to form mechanically strong liquid impervious sealing joints during the manufacturing of containers. Since additional thermoplastic now is applied on the zone 6 at the cut edges, these joints will be additionally strengthened.

The film 3 used is an integral part of the construction of the packaging laminate 1 and also fulfills other functions in the completed container. For example, the film protects a decorative coating, if any, when it is applied on the outside of the container. The film 3 can also be applied on the inside of the container in order to prevent contact between the laminate and the later on filled food. However, in this case the protruding portion 5 will partly end on the decoration side of the container.

It has also surprisingly been shown that edge covering of the cut edges of a container by means of folding over also protects against shrinkage of the layers included in the packaging laminate. When for example a packaging laminate is heated, which on its inside has an aluminium foil with a polyethylene layer applied on the outside, the plastic will shrink and draw away the adhering foil, which results in an exposure of the coating at sensitive places. This is avoided by protecting the cut edges of the packaging laminate in the completed container by means of said folding over.

The two longitudinal cut edges of a material web are according to the invention preferably covered and protected by means of folding over. The remaining cut edges are for example protected by means of what is called skiving. According to this known technique a reduction of the thickness of the packaging laminate takes place. The freely exposed and soaking cut edge formed thereupon is sealed and protected by the attenuated part of the laminate then being folded in over half of the skived portion in such a way that a part of the remaining laminate now covers the remaining skived portion. Finally, the ultimate form of the container is obtained by a further forming and sealing operation to a dimensional stable and liquid impervious packaging container.

All openings and places on exposed cut edges, which permit leakage or passage of water and/or steam, either with or without pressure, can in a container according to the invention also be protected by applying a covering substance with good filling properties on the cut edges. In this connection the covering substance can for example be in a liquid or semi-solid form, and the application can for example take place by the cut edges being sprayed with the substance or by the cut edges being dipped into the same.

The application of the covering substance on the packaging container partly manufactured from a material web can take place any time during the folding before the container is finally closed. When applied, the sheet partly converted to a container is preferably dipped into a solution which contains the covering substance.

By providing a container, in which according to the invention all the cut edges are chemically protected, a further advantage is obtained in that material in layers not in close contact with the inside of the container cannot be dissolved and/or leaked out into the filling material of the same. This is of special importance when a layer in the packaging laminate is used, which is not approved for direct contact with food.

The covering substance applied on the cut edge can be a lacquer, a hot melt adhesive, or an impregnating agent. All substances should be able to resist high temperatures.

In this connection a lacquer means a non-pigmented liquid with an organic film forming substance which can be a natural resin, a synthetic resin, or an oil.

The hot melt adhesive refers to an adhesive which usually is based on some thermoplastic. When heated, the adhesive forms a more or less liquid mass which is applied in a melted form and which binds by means of cooling, such as one which is based on a copolymer of wax-ethylene-vinyl acetate. Preferably, APAO ("attic poly-α-olefin") is used, which is a melt film based on polypropylene.

An impregnating agent refers to different kinds of natural oils, resins, waxes, paraffins, fats, proteins, and polysaccharides, either as such or by derivative formation. Polymerized organic compounds can also be used as impregnating agents, and a silicon is preferably used. A sodium silicate can also be used as an impregnating agent.

What is claimed is:

1. A process for manufacturing a liquid impervious container, for containing preselected food products, which will be subjected to autoclavation, said process comprising the steps of:

(a) providing a packaging laminate including a base layer of at least one of paper and cardboard and at least one plastic layer applied thereon;

(b) folding said packaging laminate so that all cut edges are at least one of mechanically protecting said cut edges by folding said plastic layer over said cut edges and chemically protecting certain said cut edges by a polymeric film on one of two sides of said container being folded over said certain cut edges and other cut edges being protected by means of skiving;

(c) filling said container with such preselected food products; and (d) sealing said container.

2. A process for manufacturing a container as claimed in claim 1, wherein said process further includes the step of selecting said polymeric film from a group of polymers including linear low density polyethylene, oriented polypropylene, metalized oriented polypropylene, high density polyethylene, metalized high density polyethylene, polyethylene terephthalate, metalized oriented polyethylene terephthalate, and amorphous polyethylene terephthalate.

3. A process for manufacturing a container as claimed in claim 1, wherein said process further includes the step of chemically protecting said cut edges.

4. A process for manufacturing a container as claimed in claim 3, wherein said process further includes the step of protecting said cut edges with a lacquer.

5. A process for manufacturing a container as claimed in claim 3, wherein said process further includes the step of protecting said cut edges with a hot melt adhesive.

6. A process for manufacturing a container as claimed in claim 5, wherein said process further includes the step of selecting attic poly-α-olefin (APAO) as said hot melt adhesive.

7. A process for manufacturing a container as claimed in claim 3, wherein said process further includes the step of chemically protecting said cut edges with an impregnating agent.

8. A process for manufacturing a container as claimed in claim 7, wherein said process further includes the step of selecting said impregnating agent from a group including silicones and sodium silicates.

* * * * *